United States Patent [19]

Aschberger et al.

[11] Patent Number: 4,757,924

[45] Date of Patent: Jul. 19, 1988

[54] ELECTROMAGNET SYSTEM FOR INFLUENCING A DIPPER ARMATURE

[75] Inventors: Matthias Aschberger; Karlheinz Färber, both of Giengen; Anton Deininger, Bachhagel, all of Fed. Rep. of Germany

[73] Assignees: The Coca-Cola Company, Atlanta, Ga.; Bosch-Siemens Hausgerate GmbH, Munich, Fed. Rep. of Germany

[21] Appl. No.: 768,215

[22] Filed: Aug. 22, 1985

[30] Foreign Application Priority Data

Aug. 22, 1984 [DE] Fed. Rep. of Germany ..... 3430919
Aug. 22, 1984 [DE] Fed. Rep. of Germany ..... 3430951

[51] Int. Cl.[4] ..... B67D 3/00

[52] U.S. Cl. ..... 222/504; 222/525; 251/129.15

[58] Field of Search ..... 222/504, 333, 522, 525; 335/281, 280; 251/65, 129.15, 129.16

[56] References Cited

U.S. PATENT DOCUMENTS

| | | | |
|---|---|---|---|
| 1,776,625 | 9/1930 | Henderson | 194/320 |
| 2,962,593 | 11/1960 | Thomas | 251/65 X |
| 3,152,290 | 10/1964 | Cassano et al. | 335/281 |
| 3,314,032 | 4/1967 | Van Erden | 336/198 |
| 3,652,054 | 3/1972 | Layton | 251/65 |
| 3,792,392 | 2/1974 | Pohl | 335/270 |
| 4,011,969 | 3/1977 | Martin | 222/504 X |
| 4,015,755 | 4/1977 | Lerner et al. | 222/504 X |
| 4,210,890 | 7/1980 | Olsen | 335/281 |
| 4,378,079 | 3/1983 | Kückens | 222/504 X |
| 4,450,987 | 5/1984 | Boettcher et al. | 222/504 X |
| 4,496,078 | 1/1985 | Nelzow et al. | 222/87 |
| 4,496,922 | 1/1985 | Pardee | 335/281 |

FOREIGN PATENT DOCUMENTS

| | | | |
|---|---|---|---|
| 892640 | 7/1949 | Fed. Rep. of Germany . | |
| 1255531 | 6/1965 | Fed. Rep. of Germany . | |
| 1614545 | 6/1967 | Fed. Rep. of Germany . | |
| 2226061 | 5/1972 | Fed. Rep. of Germany . | |
| 2408917 | 2/1974 | Fed. Rep. of Germany . | |
| 2820744 | 5/1979 | Fed. Rep. of Germany . | |
| 3322276 | 6/1983 | Fed. Rep. of Germany . | |
| 2164485 | 12/1971 | France . | |
| 7703679 | 10/1978 | Netherlands | 222/504 |
| 436717 | 11/1935 | United Kingdom . | |
| 2132416 | 7/1984 | United Kingdom . | |

*Primary Examiner*—Joseph J. Rolla
*Assistant Examiner*—Edward S. Ammeen
*Attorney, Agent, or Firm*—Birch, Stewart, Kolasch & Birch

[57] ABSTRACT

Electromagnet system for influencing a dipper armature forms part of a closing unit. A solenoid coil with a U-shaped magnetic core for influencing a dipper armature is mounted on a cylindrical core and has on each end a flat pole piece, each of which is connected to the cylindrical core so as to be connected mechanically and conduct magnetically. The U-shaped magnetic flux element of the electromagnet system is mounted with its two pole pieces on support bars of the recipient housing. Stop lugs are mounted on the field spool and are locked in position with appropriately shaped parts of the recipient housing.

8 Claims, 3 Drawing Sheets

ELECTROMAGNET SYSTEM FOR INFLUENCING A DIPPER ARMATURE

The invention relates to an electromagnet system having a magnet armature that dips into a magnetic field generated by the electromagnet between two pole pieces of a U-shaped magnet core and which, in particular, forms part of a dosing unit in a beverage dispenser for measuring beverage concentrates.

It is common practice to use electromagnet systems with a U-shaped magnet armature in order to provide favorable conditions for removing beverage containers from the front of a beverage dispenser. The dosing valve is inserted between the pole pieces of the magnet. The control element of the dosing valve is designed as a dipper armature made of a ferromagnetically conductive material. As is well known, dipper-armature magnet systems have the property that the magnetic attraction forces, while relatively weak when compared to other magnetic systems, exert a relatively uniform effect over a fairly long armature path. The forces that can be exerted by the electromagnet on the magnet armature are to a large extent dependent on how the magnetic flux is conducted and, in particular, how the air gaps make their appearance.

Frequently, so many problems are encountered during the manufacture of electromagnet systems that the design of the magnet cores in the area of the magnet pole shoes have an adverse effect on the winding of the solenoid coil. Therefore, a number of solutions have been proposed in the past in which the magnet cores are split and, after the solenoid coil has been wound, are united therewith.

The major object of the invention is to provide an electromagnet system with U-shaped pole pieces for the purpose of influencing a dipper armature and which, from the production-engineering standpoint, is designed as simply as possible and, in functional terms, meets the demands for a favorable magnetic flux. Also, the system satisfies the requirements for a space-saving assembly.

According to the invention, an electromagnet system that meets these requirements quite satisfactorily is characterized in that the solenoid coil is located on a cylindrical core made of ferromagnetically conductive material and which has a flat pole piece on each end, likewise made of ferromagnetically conductive material, and that the flat pole pieces are connected to the cylindrical core so as to be connected mechanically and conduct magnetically.

Advantageously, direct current will be applied to such an electromagnet system so as to obtain the strongest possible magnetic forces. The electromagnet system incorporating the invention satisfies all of the requirements with respect to production engineering, functioning and assembly as set forth in the problem definition. The field spool, which is wound with insulated wire, can be wound mechanically, after which it is mounted on the cylindrical core. Then, the flat pole pieces are attached as pole shoes to this cylindrical core so as to be connected mechanically and conduct magnetically. The flat design of the pole pieces is also advantageous for the utilization of magnetic flux in the area of the dipper armature and produces a broad homogeneous magnetic field on this location. The electromagnet system with the flat pole shoes also offers very favorable mounting. Its width is relatively small and provides for a smooth wall. Yet, the magnetic flux emerging from the solenoid coil, particularly from the front, is captured by the flat edgewise pole pieces and is directed carefully to the area of the dipper armature.

According to a preferred embodiment, the electromagnet system of the invention is characterized in that the flat pole pieces have a cross section that tapers toward the free ends. This takes account of the fact that the magnetic flux diminishes in the pole pieces toward the free ends, because the magnetic field extends over a wide area of the magnet armature between the flat edgewise pole pieces. Thus, in addition to reducing its weight, a favorable effect on the magnetic field is achieved as a result of the tapering toward the free ends of the flat edgewise pole pieces.

According to another preferred embodiment, the novel electromagnet system is characterized in that the field spool has lugs for the mechanical alignment of the flat pole pieces. In this way, the flat pole pieces, after being mounted on the cylindrical core in appropriate cylindrical holes, can be adjusted to one another and to the field spool. Then, the cylindrical core is simply keyed or riveted in the cylindrical apertures of these flat pole pieces to form a single unit.

Preferably, the electromagnets incorporating the invention can very advantageously be inserted in a housing by providing the end flanges of the field spool with stop lugs which cooperate with the stop lugs in the housing.

As part of this system designed in accordance with the novel features, the pole pieces of the U-shaped magnetic flux element are advantageously equipped with supporting surfaces for proper bearing on the bearing faces in the housing.

The steps taken in accordance with these features for improving the invention are well-suited to the arrangement and mounting within a housing of an electromagnet with a U-shaped magnetic flux element. By means of the pole pieces of the U-shaped magnetic flux element, the electromagnet is supported in the housing, while the stop lugs on the field spool provide for the locking in the housing. Therefore, no further attachment members are necessary. Since the field spool is usually and preferably made of plastic, very little production-engineering effort is required for attaching the electromagnet in the housing. By appropriately engaging the stop lugs on the field spool with the supporting surfaces of the U-shaped magnetic flux element, the electromagnet can be secured in the housing by connecting it through its shape. In this case, it is expedient to locate the stop lugs of the field spool in the vicinity of the plane formed by the supporting surfaces of the magnetic flux element.

An embodiment designed in accordance with the features of the invention will now be described with reference to the accompanying drawing, in which.

Figure 6:
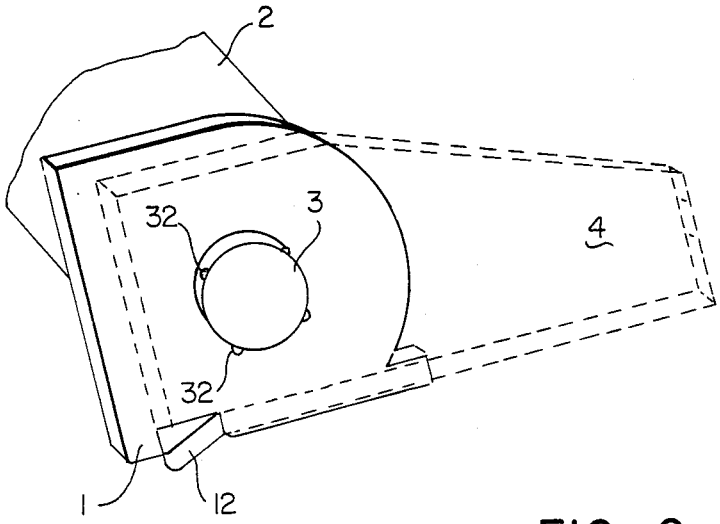
FIG. 6 is a perspective type partial view showing the field spool and the cylindrical core in solid lines and a flat pole piece in broken lines.

A solenoid coil 2 mounted on a field spool 1 is disposed on a cylindrical core 3 made of a ferromagnetically highly conductive material. Two flat pole pieces 4 are located on the ends of the field spool 1 and thereby on the ends of the solenoid coil 2, said pole pieces 4 having cylindrical apertures into which the cylindrical core 3 is keyed. Any conventional method of keying two elements together may be utilized. As shown in FIG. 6, 32 indicates conventional keys.

The free ends of the flat pole pieces protrude into the area of a dosing valve provided for measuring beverage concentrates, such as that used in apparatus for mixing refreshment beverages. A part of the distributing slide valve 6 of this dosing unit 5 consists of a ferromagnetically conductive material and can thus be controlled as a dipper armature 7 between the free ends of the flat pole pieces. The magnetic field in the area where it is utilized is distributed and concentrated in accordance with the requirements of the apparatus by the tapering of the flat pole pieces 4 toward their free ends.

Figure 1:
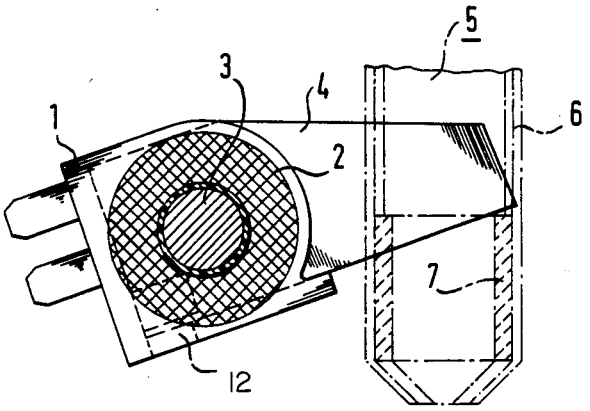
FIG. 1 is a side view, partially in section, of the electromagnet system.
Figure 2:
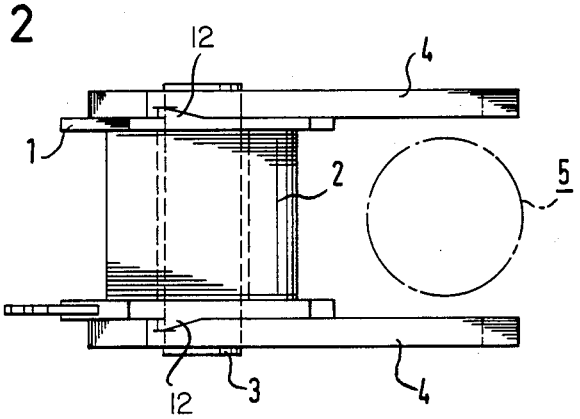
FIG. 2 is a schematic plan view of this electromagnet system.

In the area of the solenoid coil 2 the flat pole pieces 4 overlap the cross section of this coil, so that the magnetic fields emerging on the end surface from the coil can be properly captured. Among other purposes, the lugs 12 on the field spool 1 serve to align the flat pole pieces 4 relative to the field spool 1 and thereby also to one another during the preliminary assembly. In this regard, as viewed in FIGS. 1, 4 and 6, for example, the lower edge of each pole piece 4 bears against the upper edge of each lug 12 so that the lugs 12 provide a mechanical alignment of the pole pieces 4. In addition, these lugs 12 also serve as latching elements during assembly of the electromagnet system in a housing.

Figure 3:
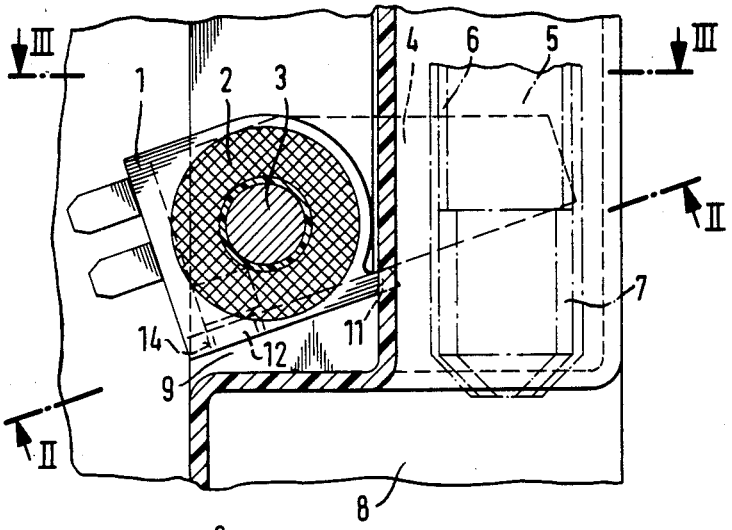
FIG. 3 is a side view, in section, of the electromagnet system in a housing.
Figure 4:
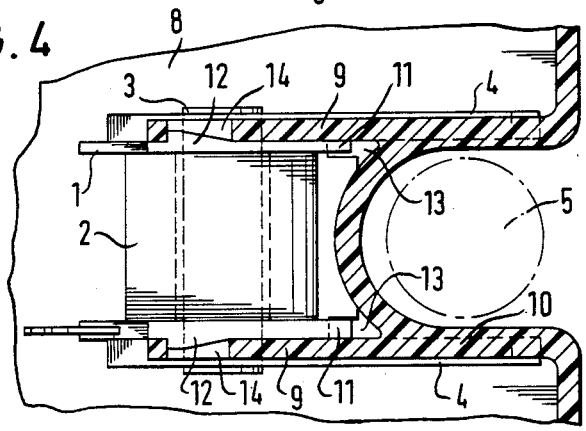
FIG. 4 is a view of this system from the bottom and in section.
Figure 5:
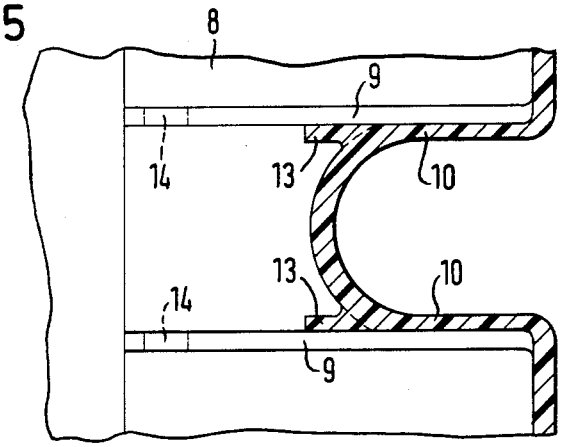
FIG. 5 is a view of the housing section, from the top and in section, for receiving this electromagnet system.

As apparent from FIGS. 3–5, the flat pole pieces 4 in the device housing 8 lie on supporting bars 9 and are centered relative to the dosing unit 5 by the housing bulge 10. Stop lugs 11, 12 are arranged in pairs on the end flanges of the field spool 1 for attachment in the operative position. Through the stop lugs 11 the electromagnet system remains pressed against the support bars 9 by means of the stop lugs 13 of the housing. The stop lugs 12 of the field spool 1 engage in recesses 14 in the support bars 9. These stop lugs 12 are wedge-shaped so that the electromagnet system on the support bars 9 can be pushed into its operative position in which the stop lugs 11 of the field spool 1 come to lie beneath the stop lugs 13 of the housing, and spreading elastically the support bars 9, which are held in position through the shape of the stop lugs 12. However, by spreading the support bars 9 by means of a tool, the electromagnet system can again be taken out of the device housing 8. In the operative position, the electromagnet system are locked against lateral movement by the end flanges of the solenoid coil 2 being between the support bars 9.

We claim:

1. An electromagnet system for use as part of a closing unit in beverage dispensers for measuring beverage concentrate comprising a cylindrical core (3) made of a ferromagnetically conductive material, a solenoid coil (2) mounted on a field spool (1) located on said cylindrical core (3), a flat pole piece (4) having flat parallel sides and made of a ferromagnetically conductive material being located on each end of said cylindrical core (3), said flat pole pieces (4) being connected to said cylindrical core (3) so as to conduct magnetically and form a U-shaped magnetic flux element, a dipper armature (7) located between said flat pole pieces (4) and being mounted for reciprocating movement, and said field spool (1) has lugs (12) for the mechanical alignment of the flat pole pieces (4).

2. An electromagnet system for use as part of a closing unit in beverage dispensers for measuring beverage concentrate comprising a housing having stop lugs therein, a cylindrical core (3) made of a ferromagnetically conductive material, a solenoid coil (2) mounted on a field spool (1) located on said cylindrical core (3), a flat pole piece (4) having flat parallel sides and made of a ferromagnetically conductive material being located on each end of said cylindrical core (3), said flat pole pieces (4) being connected to said cylindrical core (3) so as to conduct magnetically and form a U-shaped magnetic flux element, a dipper armature (7) located between said flat pole pieces (4) and being mounted for reciprocating movement, and said field spool (1) has end flanges which have stop lugs (11, 12) which cooperate with said stop lugs (13, 14) located in said housing (8).

3. An electromagnet system according to claim 2, characterized in that said housing has bearing faces and the pole pieces (4) of the U-shaped magnetic flux element have support surfaces bearing said bearing faces in said housing (8).

4. An electromagnet system according to claim 3, characterized in that via said support surfaces of the magnetic flux element and said bearing faces in the housing on the one hand and said stop lugs (11, 12) of the field spool (1) and said stop lugs (13, 14) in the housing (8) on the other the electromagnet and the housing (8) are connected through their shape.

5. An electromagnet system according to claim 4, characterized in that said stop lugs (11, 12) of the field spool (1) lie in the vicinity of a plane formed by the support surfaces of the magnetic flux element (4).

6. An electromagnet system according to claim 3, characterized in that said bearing faces in the housing for supporting the electromagnet are formed via the pole pieces (4) by support bars (9) which abut on both sides on an end face against the field spool (1).

7. An electromagnet system according to claim 6, characterized in that said support bars have stop recesses and the stop lugs (12) of said field spool (1) engage laterally in said stop recesses (14) of the support bars (9).

8. An electromagnet system according to claim 7, characterized in that the stop lugs (12) of said field spool are wedge-shaped.

* * * * *